United States Patent [19]

Nakamura et al.

[11] Patent Number: 4,494,496

[45] Date of Patent: Jan. 22, 1985

[54] VARIABLE VALVE-TIMING APPARATUS IN AN INTERNAL-COMBUSTION ENGINE

[75] Inventors: Norihiko Nakamura, Mishima; Toyokazu Baika, Susono, both of Japan

[73] Assignee: Toyota Jidosha Kabushiki Kaisha, Toyota, Japan

[21] Appl. No.: 464,105

[22] Filed: Feb. 4, 1983

[30] Foreign Application Priority Data

Mar. 24, 1982 [JP] Japan ..... 57-45536

[51] Int. Cl.[3] ..... F01L 1/34

[52] U.S. Cl. ..... 123/90.15; 123/90.17

[58] Field of Search ..... 123/90.15, 90.17; 464/1, 120

[56] References Cited

U.S. PATENT DOCUMENTS

| | | | |
|---|---|---|---|
| 1,632,223 | 6/1927 | Fey | 123/90.17 |
| 2,682,260 | 6/1954 | Lantz | 123/90.15 |
| 3,945,221 | 3/1976 | Miokovic | 123/90.17 X |
| 3,978,829 | 9/1976 | Takahashi et al. | 123/90.17 X |
| 4,279,131 | 7/1981 | Pringle | 64/21 |

*Primary Examiner*—Michael Koczo
*Assistant Examiner*—Peggy A. Neils
*Attorney, Agent, or Firm*—Kenyon & Kenyon

[57] ABSTRACT

An apparatus for controlling valve timing in an internal-combustion engine. The apparatus includes a pair of sleeves inserted into each other. One of the sleeves is connected to the camshaft and the other sleeve is connected to a timing pulley which is connected to the crankshaft. One of the sleeves has diametrically opposed slits and the other sleeve has diametrically opposed slits located adjacent to the corresponding slits in the first sleeve. Abutment rollers are arranged in the slits and are mounted on an axially slidable slider. Movement of the slider causes the generation of an angular displacement between the sleeves, resulting in variable valve timing. A bearing unit is arranged between the inner and the outer sleeves.

8 Claims, 4 Drawing Figures

VARIABLE VALVE-TIMING APPARATUS IN AN INTERNAL-COMBUSTION ENGINE

DESCRIPTION OF THE INVENTION

The present invention relates to an internal-combustion engine variable valve-timing apparatus wherein the valve timing of the intake valve and/or exhaust valve is controlled by a pair of sleeve members which are connected to the crankshaft and the camshaft, respectively. More particularly, the present invention relates to an apparatus capable of smoothly and quickly varying valve timing in an internal-combustion engine.

Variable control of valve timing is necessary to attain maximum output in all of the operating conditions of an engine, e.g., engine rotational speed and engine load. Various apparatuses for varying valve timing have heretofore been proposed. These conventional apparatuses include differential gears or planetary gears. However, such known apparatuses have a drawback in that a certain degree of backlash inevitably occurs, causing the operational noise to increase and the transmission efficiency and reliability to decrease.

In order to overcome the difficulties encountered in the prior art, the applicant previously proposed an apparatus which includes a pair of sleeves which are connected to the crankshaft and the camshaft of the engine. Slits, which are inclined toward each other, are formed in the sleeves. Bearings are located in the slit so that relative angular displacement of the sleeves is generated due to linear movement of the bearings. When angular displacement occurs, the valve timing varies. Such variable valve timing is, when compared with the conventional apparatuses including differential gears or planetary gears, advantageous in that no backlash takes place and thereby the operational noise is decreased and the transmission efficiency and reliability are increased.

An object of the present invention is to provide an improved variable valve-timing apparatus by which valve timing can be smoothly and quickly varied.

According to the present invention an apparatus is provided for controlling the relative angular relationship between two rotating bodies interconnected with each other so as to have a common axis of rotation, said apparatus comprising:

a first sleeve member which is fixedly connected to one of said bodies;

a second sleeve member which is fixedly connected to the other of said bodies;

means arranged between said first and second sleeve members for allowing relative rotation therebetween without much friction;

said first and second sleeve members having adjacent slits extending substantially along the axis thereof so that said slits are inclined toward each other;

abutment means arranged in the adjacent slits for generating a relative angular displacement between said first and second sleeve members during movement of the abutment means along the first axis;

support means for rotatably supporting the abutment means around a second axis transverse to the first axis; and means for moving the support means along said first axis.

The present invention is now described with reference to the attached drawings, in which.

Figure 1:
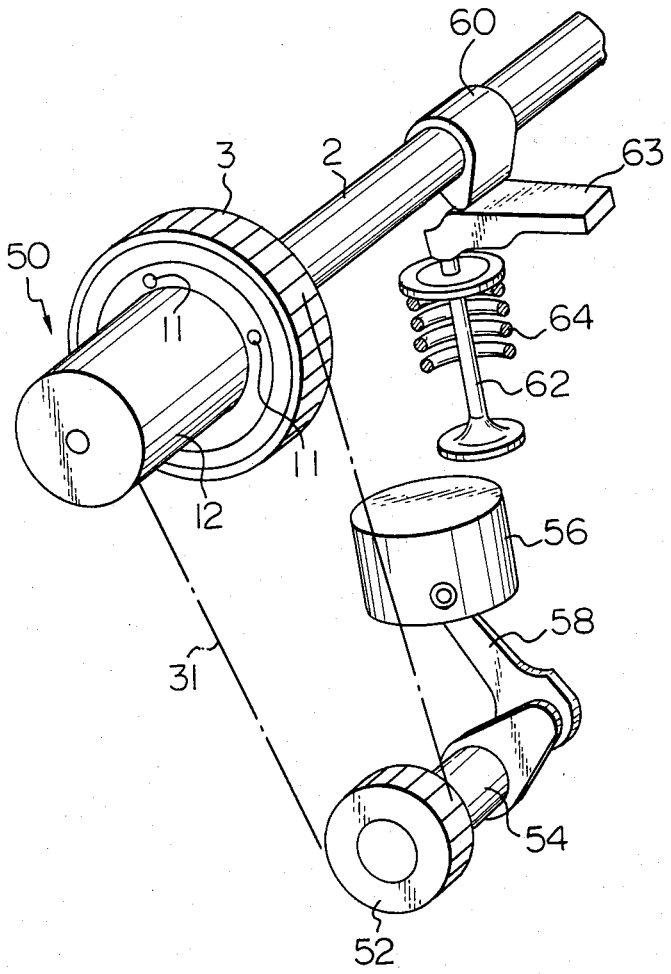
FIG. 1 is a perspective view of a crankshaft connected to a camshaft in an internal-combustion engine.
Figure 2:
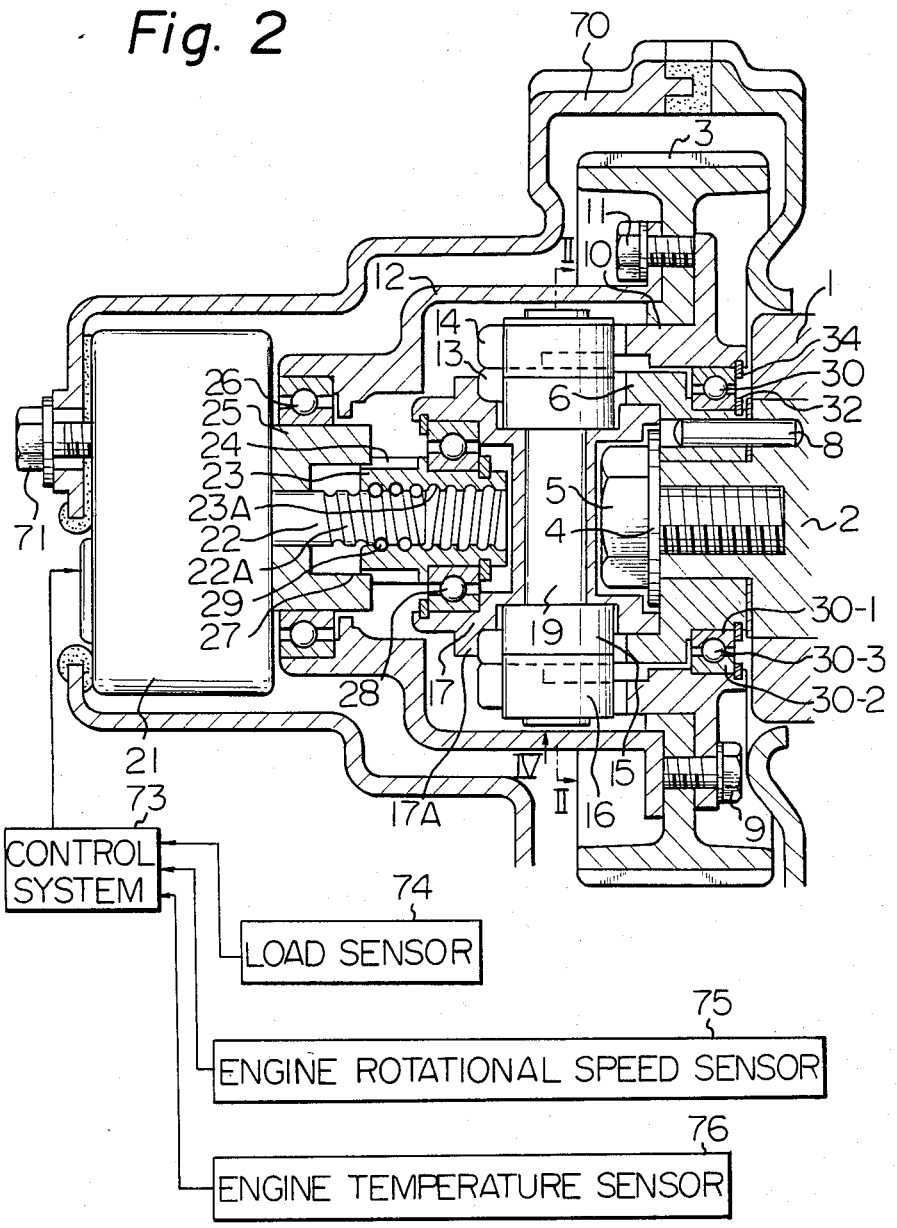
FIG. 2 is a longitudinal cross-sectional view of the apparatus of the present invention which has a drive system responsive to the operating condition of the engine.

In FIG. 1, reference numeral 2 denotes a camshaft. The camshaft 2 is rotatably supported on a cylinder head 1 (FIG. 2). To one end of the camshaft 2, a timing pulley 3 is connected via an apparatus 50 for controlling the angular relationship between two rotating bodies of the present invention. The timing pulley 3 is connected via a timing belt 31 to a timing pulley 52 on a crankshaft 54. A piston 56 is connected to the crankshaft 54 with a connecting rod 58. A cam 60 is integrally formed on the camshaft 2 and cooperates with an intake and/or an exhaust valve 62. A rocker arm 63 is arranged between the cam 60 and the valve 62. A spring 64 pushes the valve stem toward the cam 60 so that the valve is normally closed.

The apparatus 50 is adapted for controlling the relative angular relationship between the camshaft 2 and the timing pulley 3 of the internal-combustion engine so as to control the timing of the valve 62. The apparatus includes, as is shown in FIG. 2, an inner sleeve 6 mounted onto the camshaft 2. The inner sleeve 6 is fixedly connected to the camshaft 2 with a washer 4 and a bolt 5. A lock pin 8 is inserted into the inner sleeve and the camshaft 2 so that no relative rotation takes place between these parts.

An outer sleeve 10 is fixedly connected to the timing pulley 3 with a bolt 9, and a case 12 is connected to the timing pulley 3 with a bolt 11. The outer sleeve 10 is rotatably mounted on the inner sleeve 6.

Figure 3:
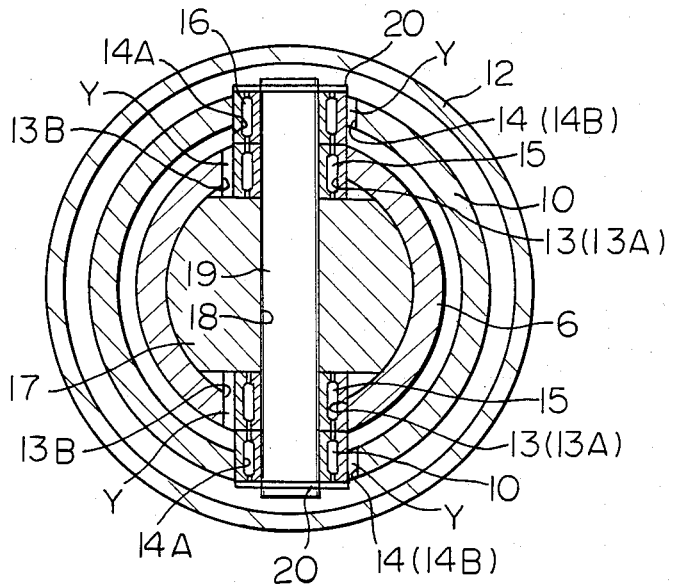
FIG. 3 is a cross-sectional view along the line II—II in FIG. 2.
Figure 4:
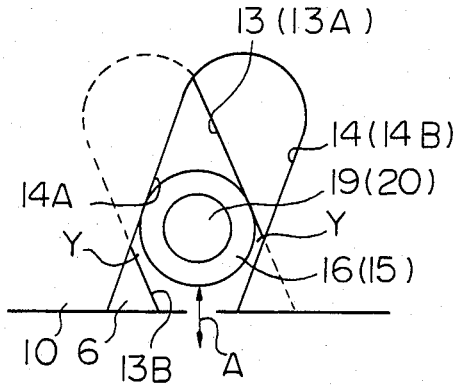
FIG. 4 is a plan view along the line IV in FIG. 2.

As is shown in FIG. 3, the inner sleeve 6 has a pair of diametrically opposed slits 13, and the outer sleeve 10 has a pair of diametrically opposed slits 14 located adjacent to the corresponding slits 13 in the inner sleeve 6. The adjacent slits 13 and 14 are skewed with respect to each other, as is shown in FIG. 4. The slits 13 have facing inner edges 13A and 13B, and the slits 14 have facing inner edges 14A and 14B. Rollers 15 and 16, as abutment members, are located in the slits 13 and 14, respectively. The rollers 15 and 16 have a common axis of rotation from which the central axes in the adjacent slits 13 and 14 are oppositely spaced. Thus, the adjacent rollers 15 and 16 contact the inner edges 13A and 14A, respectively, and are spaced from the inner edges 13B and 14B, respectively, so that clearances Y are provided between the rollers 15 and 16 and the corresponding inner edges 13B and 14B, respectively. Due to this single contact arrangement of the rollers 15 and 16, backlash between the sleeve members 6 and 10 is mitigated when the rollers 15 and 16 move along the slits 13 and 14, respectively.

As is shown in FIG. 3, the central axis of the diametrically opposed slits 13 is located on one side of the axis of the rollers while the central axis of the diametrically opposed slits 14 is located on the opposite side of the axis of the rollers. Due to this arrangement, no backlash takes place when the camshaft is loaded in either direction.

The rollers 15 and 16 are mounted on a common shaft 19 passing through a bore 18 formed in a slider 17. Clips 20 prevent the rollers 15 and 16 from falling off the shaft 19. Each of the rollers is comprised of a bearing unit having an inner race, an outer race, and needles arranged therebetween.

As is shown in FIGS. 2 and 3, the slider 17 is axially slidably inserted into the inner sleeve 6. The slider 17 has an annular projection 17A which contacts the inner sleeve 6 during movement of the slider 17 toward the camshaft 2 and which contacts the case 12 during movement of the slider 17 away from the camshaft 2. Thus, the slider can effect axial movement within a limited range.

A drive mechanism is provided for generating such axial movement of the slider 17. Reference numeral 21 denotes a rotary motor, such as an electric motor or hydraulic motor. The rotary motor 21 is secured to a timing pulley cover 70 with a bolt 71. The rotary motor 21 has an output shaft 22 on which an outer screw ball race 22A is formed. Reference numeral 23 denotes a sleeve nut having an inner screw ball race 23A which engages via balls 29 with the outer screw ball race 22A of the shaft 22. The sleeve nut 23 has a pair of diametrically opposed guide grooves 24 which extend axially.

A guide ring 25 fixedly connected to the motor housing has a pair of diametrically opposed guide projections 27 inserted into the guide grooves 24 in the sleeve nut 23. Thus, the rotary movement of the shaft 22 is transformed into an axial slide movement of the sleeve nut 23. On the guide ring 25, a bearing unit 26 for rotatably supporting the case 12 is mounted. On the sleeve nut 23, a bearing unit 28 is mounted. The bearing unit 28 is adapted, on the one hand, for rotatably supporting the slider 17 and, on the other hand, for transmitting the linear movement of the sleeve nut 23 to the slider 17.

In the present invention, a bearing unit 30 is arranged between the inner sleeve 6 and the outer sleeve 10. The bearing unit 30 has an inner race 30-1 which is connected to the inner sleeve 6 with a clip 32, an outer race 30-2 which is connected to the outer sleeve 10 with a clip 34, and balls 30-3 arranged between the inner and the outer races.

Now the operation of the apparatus according to the present invention will be described. The rotational movement of the crankshaft 54 is transmitted to the timing pulley 3 via the timing belt 31. Thus, the outer sleeve 10 rotates together with the timing pulley 3 so that a force is applied to the rollers 16 to rotate the rollers about the axis of the camshaft 2. As a result, the slider 17, together with the common shaft 19, rotates. The rotational movement of the common shaft 19 causes the slits 13 of the inner sleeve 6 to engage with the rollers 15 therein, thereby causing the camshaft 2 to rotate. Thus, the crankshaft 54 is connected to the camshaft 2 during rotation. In other words, the timing pulley 3 and the camshaft 2 rotate integrally with each other so that the predetermined angular relationship between the crankshaft 54 and the camshaft 2 is maintained. Thus, the valve 62 which cooperates with the cam 60 on the camshaft 2 operates within a predetermined angle range of the crankshaft 54 to open or to close the valve 62, and thereby a predetermined variation in valve timing is obtained.

When it is necessary to change the valve timing due to a change in the operating condition of the engine, the rotary motor is actuated by a control system responsive to operational signal sensors, such as a load sensor 74, an engine rotational speed sensor 75, and an engine temperature sensor 76, so as to cause the output shaft 22 to rotate. The rotational movement of the output shaft 22 is changed into an axial movement of the sleeve nut 23 due to the screw engagement between the parts 22 and 23. Thus, the slider 17 connected to the sleeve nut 23 moves along the axis of the camshaft 2 (FIG. 2) in accordance with the direction of rotation of the output shaft 22 of the rotary motor 21, and thereby the shaft 19 provided with the rollers 15 and 16 in the slits 13 and 14, respectively, moves as shown by the arrow A in FIG. 4. Due to the arrangement of the slits 13 and 14, which are skewed with respect to each other, the linear movement of the rollers 15 and 16 is changed into a relative angular movement between the inner sleeve 6 and the outer sleeve 10. Thus, the relative angular position between the crankshaft 54 and the camshaft 2 is changed, with the result that the valve timing is varied.

It should be noted that the degree of angular displacement corresponds to the rotational angle of the rotary motor 21. The rotational angle of the rotary motor 21 is determined so that a predetermined variation in valve timing is obtained. Since the rollers 15 and 16 are arranged in the adjacent slits 13 and 14 in an offset manner so as that they contact the corresponding slits 13 and 14 at one point only, relative angular displacement between the inner and outer sleeves 6 and 10 is effected without backlash.

In the present invention, the bearing unit 30 is arranged between the inner and outer sleeves 6 and 10. Thus, only a small force is necessary to effect relative rotation so as to vary the valve timing, and thereby the load of the rotary motor 21 can be decreased. In addition, wearing of the facing surfaces of the inner and outer sleeves 6 and 10 is prevented, thereby lengthening the life of the device.

Many modifications may be made by those skilled in this art without departing from the scope of the present invention.

We claim:

1. An apparatus for controlling the relative angular relationship between two rotating bodies interconnected with each other so as to have a common first axis of rotation, said apparatus comprising:

a first inner sleeve member which is fixedly connected to one of said bodies coaxially with said first axis;

a second outer sleeve member which is fixedly connected to the other of said bodies coaxially around said first sleeve member;

means arranged between said first and second sleeve member for allowing relative rotation therebetween without much friction;

said first and second sleeve members having two circumferentially spaced sets of elongated first and second slits, the first slit of each set being located in the first sleeve, the second slit of each set being located in the second sleeve adjacent to the corresponding first slit in the first sleeve, the adjacent slits being skewed with respect to each other, and at least one slit in each set being skewed with respect to the first axis;

abutment means arranged in the adjacent slits of the two sets of slits, said abutment means comprising a pin extending through said first and second slits of each set and transversely intersecting the first axis, first and second annular cylindrical rollers arranged on said pin in each of said first and second slits, respectively, each roller having an outer diameter less than the width of the corresponding slit so that each of the rollers contacts only one side of the corresponding one of the slits, and means for allowing free and independent rotation of each of the rollers about the pin;

a slider on which the abutment means are mounted, said slider being movable along and rotatable about the first axis; and means for moving the slider along said first axis relative to said first and second sleeve members for generating a relative angular displacement between said first and second sleeve member in response to movement of the abutment means parallel to the first axis, wherein the two first slits are angularly offset with respect to the pin so that said first slits bear against the corresponding first rollers on one side of the pin, and the two second slits are angularly offset with respect to the pin so that said two second slits bear against the corresponding second rollers on a side of said pin opposite to said one side of the pin.

2. An apparatus according to claim 1, wherein said means arranged between said first and second sleeve members comprise a bearing unit comprising a first race, a second race, and rolling members arranged between the races and means for connecting said bearing unit to said first and second sleeve members.

3. An apparatus according to claim 2, wherein said connecting means comprise a first clip for connecting said first race of said bearing unit to said first sleeve member and a second clip for connecting said second race of said bearing unit to said second sleeve member.

4. A system according to claim 1, wherein the corresponding first slits of the two sets are diametrically opposed, and the corresponding second slits of the two sets are diametrically opposed.

5. A system for connecting, in an internal-combustion engine, a crankshaft to a camshaft, comprising;

a driven member having a first axis of rotation common to that of the camshaft;

a power-transmitting member for connecting the crankshaft to the driven member;

a first inner sleeve member fixedly connected to the camshaft;

a second outer sleeve member fixedly connected to the driven member;

said first and second sleeve members being arranged coaxially to each other and to said first axis;

means arranged between said first and second sleeve members for allowing relative rotation therebetween without much friction;

said first and second sleeve members having two circumferentially spaced sets of elongated first and second slits, the first slit of each set being located in the first sleeve, the second slit of each set being located in the second sleeve adjacent to the corresponding first slit in the first sleeve, the adjacent slits being skewed with respect to each other, and at least one slit of each set being skewed with respect to the first axis;

abutment means arranged in said sets of slits, said abutment means comprising a pin extending through said first and second slits of each set and transversely intersecting the first axis, first and second annular cylindrical rollers arranged on said pin in said first and second slits, respectively, each roller having an outer diameter less than the width of the corresponding slit so that each of the rollers is in contact with only one side of a corresponding one of the slits, and means for allowing free and independent rotation of each of the rollers about the pin;

a slider on which the abutment means are mounted, the slider being movable along and rotatable about the first axis;

drive means for moving the slider along said first axis relative to said first and second sleeve members for generating a relative angular displacement between said first and second sleeve members in response to movement of the abutment means parallel to the first axis; and means responsive to the operating conditions of the engine for operating the drive means, whereby the relative angular position of the camshaft with respect to the crankshaft is controlled so as to obtain variable valve timing, wherein the two first slits are angularly offset with respect to the pin such that said first slits bear against the corresponding first rollers on one side of the pin, and the two second slits are angularly offset with respect to the pin such that said second slits bear against a side of said pin opposite to said one side of the pin.

6. An apparatus according to claim 5 wherein said means arranged between said first and second sleeve members comprise a bearing unit having an inner race, an outer race, and rolling members arranged between said races and means for connecting said bearing unit to said first and second sleeves members.

7. An apparatus according to claim 4 wherein said connecting means comprise a first clip for connecting one of said races to said first sleeve member and a second clip for connecting the other of said races to said second sleeve member.

8. A system according to claim 5, wherein the corresponding first slits of the two sets are diametrically opposed, and the corresponding second slits of the two sets are diametrically opposed.

* * * * *